US008228240B2

(12) United States Patent
Kim et al.

(10) Patent No.: US 8,228,240 B2
(45) Date of Patent: Jul. 24, 2012

(54) PORTABLE TERMINAL

(75) Inventors: Chang-Il Kim, Gyeonggi-Do (KR); Hyun-Seock Song, Seoul (KR)

(73) Assignee: LG Electronics Inc., Seoul (KR)

( * ) Notice: Subject to any disclaimer, the term of this patent is extended or adjusted under 35 U.S.C. 154(b) by 965 days.

(21) Appl. No.: 12/244,620

(22) Filed: Oct. 2, 2008

(65) Prior Publication Data

US 2009/0111541 A1 Apr. 30, 2009

(30) Foreign Application Priority Data

Oct. 25, 2007 (KR) ..... 10-2007-0108001

(51) Int. Cl.
*H01Q 1/24* (2006.01)

(52) U.S. Cl. ..... 343/702; 343/846

(58) Field of Classification Search ..... 343/702, 343/700 MS, 846, 848
See application file for complete search history.

(56) References Cited

U.S. PATENT DOCUMENTS

| | | | | |
|---|---|---|---|---|
| 7,012,571 | B1 * | 3/2006 | Ozkar et al. | 343/702 |
| 2005/0007283 | A1 * | 1/2005 | Jo et al. | 343/702 |
| 2007/0052596 | A1 * | 3/2007 | Liu et al. | 343/702 |
| 2007/0120748 | A1 * | 5/2007 | Jenwatanavet et al. | 343/702 |
| 2007/0188391 | A1 * | 8/2007 | Tu et al. | 343/702 |
| 2008/0081657 | A1 * | 4/2008 | Suzuki et al. | 455/550.1 |
| 2008/0129612 | A1 * | 6/2008 | Wang et al. | 343/702 |

* cited by examiner

*Primary Examiner* — Hoanganh Le
(74) *Attorney, Agent, or Firm* — Birch, Stewart, Kolasch & Birch, LLP

(57) ABSTRACT

A portable terminal is provided that has a terminal body, a receiver located in the terminal body, the receiver being oriented in a first direction, and a ground unit located in the terminal body. The ground unit includes a first ground portion connected to the receiver, and a second ground portion connected to the first ground portion at a position on the first ground portion at a distance from the receiver. The second ground portion is configured to emit electromagnetic waves in a second direction away from the first direction.

21 Claims, 8 Drawing Sheets

PORTABLE TERMINAL

CROSS-REFERENCE TO RELATED APPLICATIONS

This application claims priority to Korean Patent Application No. 10-2007-0108001, filed Oct. 25, 2007, and is herein incorporated by reference in its entirety.

BACKGROUND OF THE INVENTION

1. Field of the Invention

The present invention relates to a portable terminal having a ground unit that is capable of minimizing interference between electromagnetic waves generated from the portable terminal and a hearing aid.

2. Description of Related Art

Portable terminals are easily carried devices that have one or more of functions such as supporting voice calls and other telephony functions, inputting and/or outputting information, storing data and the like. As the portable terminals become multi-functional, they incorporate additional functions, such as capturing still images or moving images, playing music or video files, playing games, receiving broadcasts, and the like, thereby providing integrated multimedia devices.

Currently, users are increasingly interested in effects of the electromagnetic waves generated from the portable terminal on the human body. In particular, people who use hearing aids are increasingly interested minimizing malfunctions of the hearing aid caused by the electromagnetic waves generated from the portable terminal interfering with the operation of the hearing aid when using the portable terminal.

Accordingly, manufacturers of hearing aids and other wireless devices are required to meet the Federal Communications Commission (FCC) requirements for hearing aid compatibility (HAC) in the United States. Such requirements have also spread throughout the world. The HAC serves to authenticate and evaluate compatibility of hearing aids and portable terminals such that the hearing aids and the portable terminals may be simultaneously used without too much interference therebetween. Generally, the electromagnetic waves generated from a portable terminal are sensed and amplified by a telecoil (i.e., T-coil) of a hearing aid, and thus call sound is transmitted to the hearing aid user. The HAC specifies a method for measuring a magnetic response of the hearing aid and providing a standard value thereof.

One measuring method of the HAC, as shown in FIG. 1, measures the amount of the electromagnetic waves generated at the periphery of a receiver of the portable terminal. The portable terminal includes a first body 10, and a second body 20 coupled to the first body 10 to be foldable or unfoldable therewith by pivoting the first body 10 with respect to the second body 20.

A receiver 11 is provided at one end of the first body 10, and a measuring region 12 having a size of 5(cm)×5(cm) centering on the receiver 11 and having a height of 1(cm) from the surface of the terminal is specified. The measuring region 12 is divided into nine grids total, one of which is a central grid 14, the remaining eight are border grids 13. Measurements of the value of electromagnetic waves emitted from each of the grids 13, 14 are taken by an electromagnetic wave measuring probe. The values of three of the eight border grids 13 emitting the greatest amount of electromagnetic waves are excluded from values of the eight border grids 13 surrounding the central grid 14. The HAC requires that the greatest value among values of the electromagnetic waves from the central grid 14 and the remaining five border grids 13 should be below a predetermined reference value.

Accordingly, various attempts have been made to design and fabricate portable terminals that meet the above requirements and reduce the amount of electromagnetic waves generated from the periphery of the receiver of the portable terminal.

BRIEF SUMMARY OF THE INVENTION

Therefore, the present invention is directed to minimizing interference between a hearing aid and electromagnetic waves generated from a portable terminal by reducing the amount of electromagnetic waves generated from the periphery of a receiver of the portable terminal.

To achieve these and other advantages and in accordance with the purpose of the present invention, as embodied and broadly described herein, there is provided a portable terminal having a terminal body, a receiver located in the terminal body, the receiver being oriented in a first direction, and a ground unit located in the terminal body. The ground unit includes a first ground portion connected to the receiver, and a second ground portion connected to the first ground portion at a position on the first ground portion at a distance from the receiver. The second ground portion is configured to emit electromagnetic waves in a second direction away from the first direction.

In accordance with other aspects of the present invention, a portable terminal having a terminal body, a receiver located in the terminal body, an antenna located in the terminal body, and a ground unit located in the terminal body, is also provided. The ground unit includes a first ground portion connected to the antenna, and a second ground portion connected to the first ground portion at a position spaced from the receiver. The second ground portion extends in a direction away from the receiver.

Further scope of applicability of the present application will become more apparent from the detailed description given hereinafter. However, it should be understood that the detailed description and specific examples are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments of the invention and together with the description serve to explain the principles of the invention. In the drawings.

DETAILED DESCRIPTION OF THE INVENTION

Description will now be given in detail of the exemplary embodiments of the present invention, examples of which are illustrated in the accompanying drawings.

Figure 2:
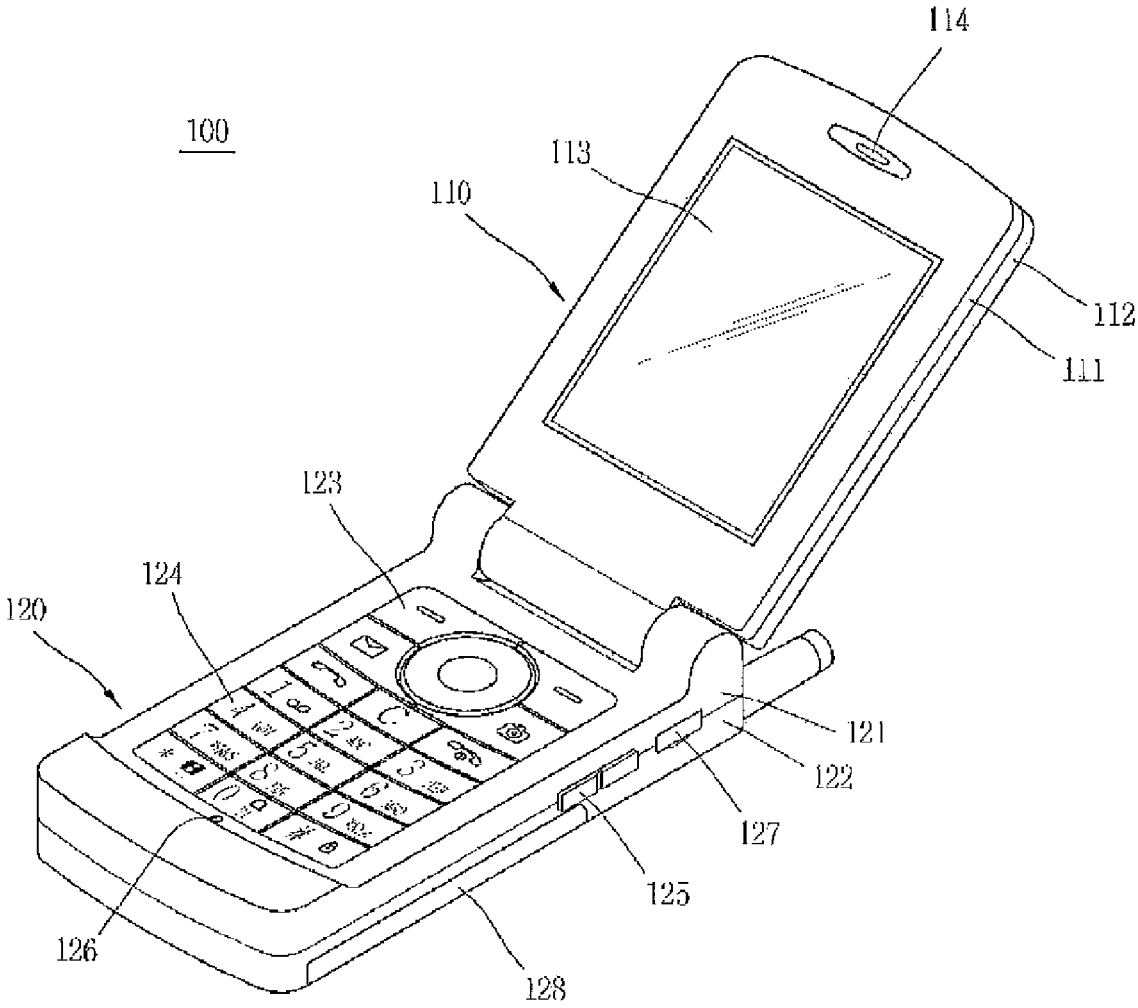
FIG. 2 is a front perspective view of a portable terminal in accordance with a first exemplary embodiment of the present invention.

FIG. 2 is a front perspective view of one exemplary embodiment of the portable terminal 100 in accordance with a first embodiment of the present invention. The portable terminal 100 includes a first body 110, and a second body 120 configured to have at least one side that is folded or unfolded with respect to the first body 110. A configuration where the first body 110 is overlapped with the second body 120 may be referred to as a closed configuration, and, as shown in FIG. 2, a configuration where at least one portion of the second body 120 is exposed by the first body 110 may be referred to as an open configuration. In the closed configuration, the portable terminal 100 may be mainly operated in a standby mode, which may be released by a user's manipulation. In the open configuration, the portable terminal may be mainly operated in a call mode, but the call mode may be converted into the standby mode by the user's manipulation or after a specified period of time without use of the portable terminal 100.

A case forming an exterior of the first body 110 includes a front case 111 and a rear case 112. Electronic components may be disposed in a space formed by the front case 111 and the rear case 112. The cases may be formed of a synthetic resin by injection molding, or formed of a metallic material, such as stainless steel (STS) or titanium (Ti).

A first display portion 113 and a sound output unit 114 are disposed at the first body 110, particularly, the front case 111. The first display portion 113 visually represents information and may be implemented as a touch screen so that the user can input information in a touching manner. The sound output unit 114 may be a receiver or a speaker. For purposes of describing the invention, the sound output unit 114 will be referred to as the receiver 114 in the following description.

The second body 120 is pivotally connected to the first body 110 by a hinge. Similar to the first body 110, a case of the second body 120 includes a front case 121 and a rear case 122. First and second manipulating portions 123, 124 are disposed at the front body 120, particularly, a front surface of the front case 121. The first and second manipulating portions 123, 124 may be used to transmit commands for controlling the operation of the portable terminal 100. A third manipulating portion 125, a sound input unit 126, and an interface 127 are disposed on one or the other of the front case 121 and the rear case 122 of the second body 120. The first to third manipulating portions 123, 124, 125 may be referred to as a manipulating portion, which can be configured to be responsive to a user's touch for manipulation. For example, the manipulating portion may be a dome switch, a touch screen, or a touch pad by which a user can input commands or information in a pushing or touching manner. Alternatively, the manipulating portion may be implemented, for example, as a wheel, as a jog switch, or as a joystick.

Functionally, the first manipulating portion 123 may be configured to input commands such as start, end, scroll, or the like, and the second manipulating portion 124 may be configured to input numbers, letters, symbols, or the like. Also, the third manipulating portion 125 can be used as a hot key which performs a specific function, such as activating an image input unit 115 (shown in FIG. 3).

The sound input unit 126 may be implemented, for example, as a microphone to receive the user's voice or other sounds.

The interface 127 may serve as a data path which allows the portable terminal to exchange data with external devices. For example, the interface 127 may be used in a wired or wireless manner, and may be at least one of a connection terminal to which an earphone is connected, or a port for a local communication (e.g., infrared data (IrDA) port, BLUETOOTH port, wireless LAN port, or the like). The interface 127 may be a card socket for receiving an external card such as a Subscriber Identification Module (SIM), a User Identity Module (UIM) or a memory card for storing information, or the like. The interface may also be used as a connection terminal to receive power from a power supply terminal.

A power supply portion 128 is provided at the rear case 122 to supply power to the portable terminal. For example, the power supply portion 128 may be a rechargeable battery, which may be detachably coupled to the portable terminal for charging.

Figure 3:
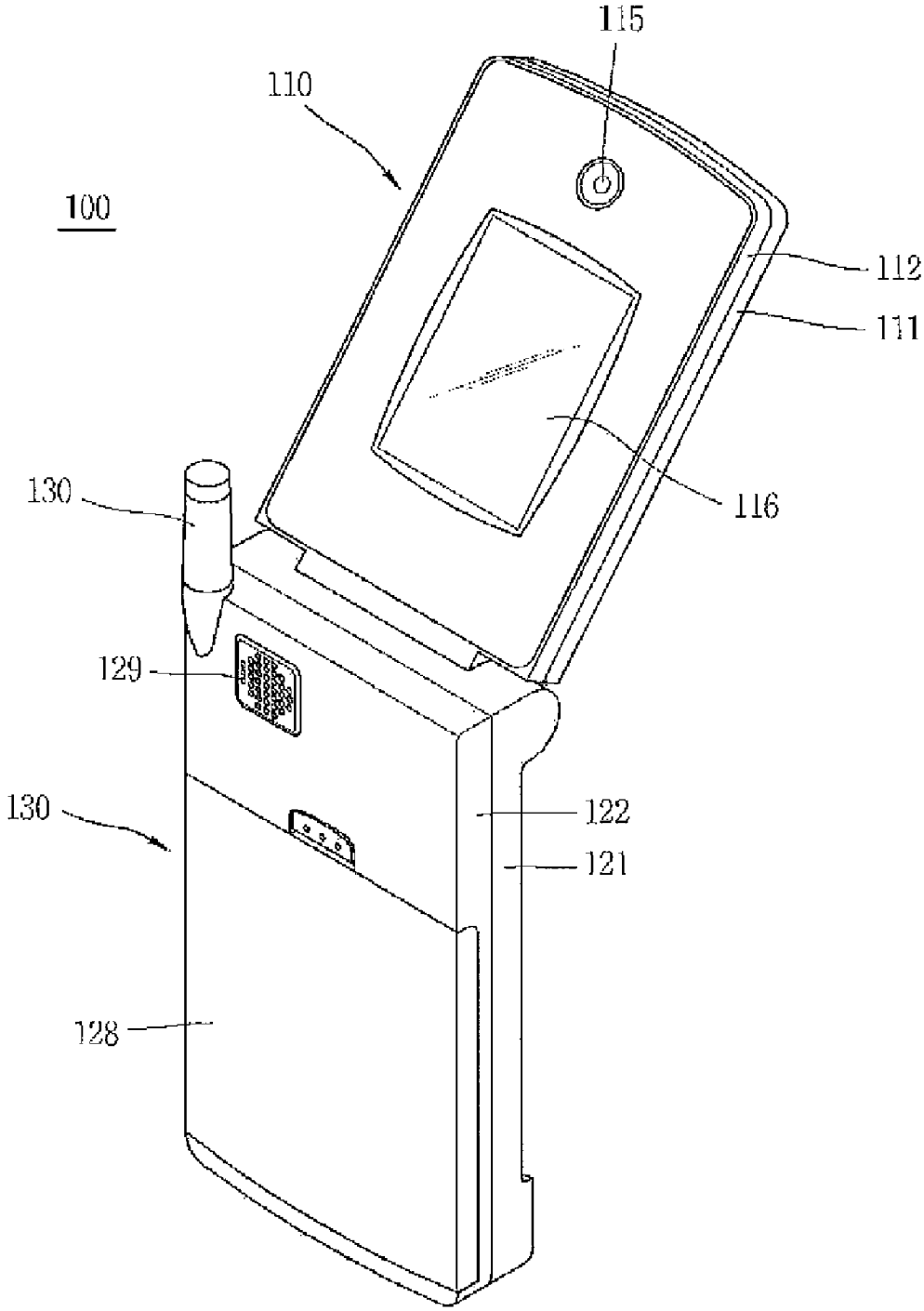
FIG. 3 is a rear perspective view of the portable terminal of FIG. 2.

FIG. 3 is a rear perspective view of the portable terminal 100. The image input unit 115 and a second display portion 116 are located at the rear case 112 of the first body 110. The image input unit 115 may be a camera module for capturing still images or moving images. The image input unit 115 may be located at the first body 110 or may be rotatably mounted at the hinge portion connecting the first body 110 to the second body 120.

Similar to the first display portion 113, the second display portion 116 operates to visually represent information and may serve as an auxiliary display for the first display portion 113. For example, the second display portion 116 may display a phone number of the other party when receiving a phone call in a standby mode, or display a received message. Additionally, image information inputted through the image input unit 115 may be outputted through the second display portion 116 when the user photographs his/her own image.

Figure 1:
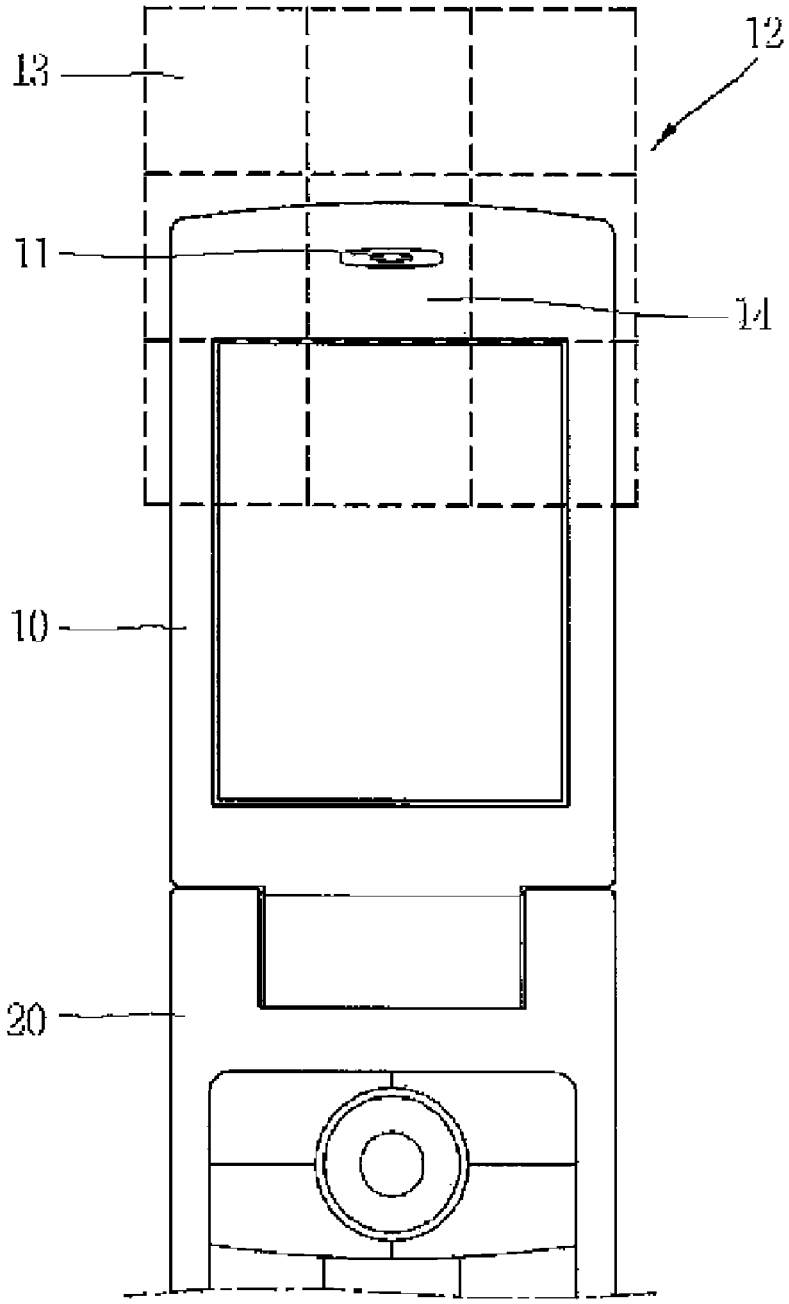
FIG. 1 is a partial plan view of a portable terminal showing a method for measuring electromagnetic waves emitted therefrom.

A second sound output unit 129 is located at the rear case 122 of the second body 120. In conjunction with the first sound output unit 1114 (Shown in FIG. 1), the second sound output unit 129, may provide a stereo function. The second sound output unit 129 may also be used for communication in a speaker phone mode.

The rear case 122 includes an antenna 130 for receiving broadcast signals in addition to an antenna 131 (Shown in FIG. 4) for radio communication. While not shown, the antenna 130 may be installed to be extendable from the second body 120.

Figure 4:
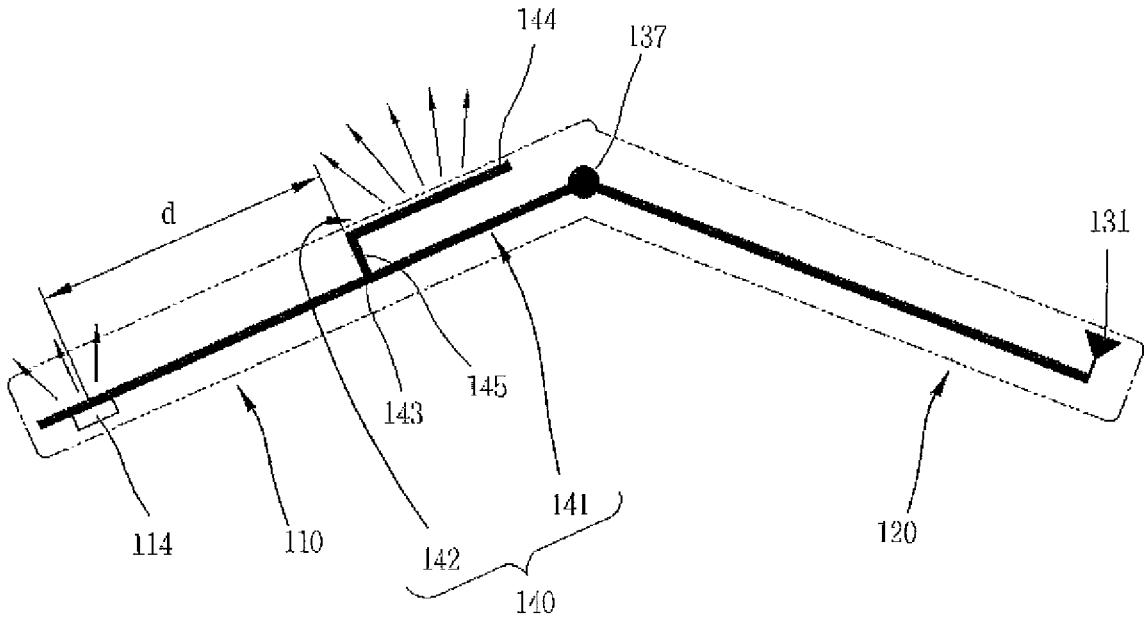
FIG. 4 is a schematic view of a ground unit of the portable terminal in accordance with the first exemplary embodiment of the present invention.

FIG. 4 is a schematic view of a ground unit 140 of the portable terminal in accordance with a first exemplary embodiment of the present invention. As shown in this figure, arrows indicate electromagnetic waves emitted from the terminal body, and the length of each arrow is representative of the amount of the electromagnetic waves being generated at that location. The receiver 114 is disposed at one end of the first body 110, particularly a portion that comes into contact with a user's ear. An antenna 131 for transmitting/receiving radio (wireless) signals is disposed at the second body 120, so that the portable terminal 100 can perform a radio communication. In this exemplary embodiment, the antenna is provided at one end of the portable terminal 100 opposite the receiver 114. The ground unit 140 is electrically connected to the antenna 131 and is located at the first and second bodies 110, 120.

The ground unit 140 includes a first ground portion 141 and a second ground portion 142 that extends from the first ground portion 141. The first ground portion 141 is electrically connected to the antenna 131, and thus emits electromagnetic waves to an outside of the portable terminal 100 together with the antenna 131 as the antenna 131 transmits/receives the signals to/from the outside of the portable terminal 100. The second ground portion 142 serves to induce a certain amount of electromagnetic waves emitted at a periphery of the receiver 114 to be emitted in a direction different from that of the receiver 114. For this purpose, the second ground portion 142 is connected to the first ground portion 141 at a position spaced from the receiver 114 by a certain distance d, (hereinafter, referred to as a 'diverged point 143') and then extends in a direction that is different from that of the receiver 114.

In this exemplary embodiment, the second ground portion 142 includes an emitting portion 144 formed at the surface of the first body 110, for emitting electromagnetic waves, and a ground connecting portion 145 extending between the diverged point 143 in the direction different from that of the receiver 114 to the emitting portion 144. The emitting portion 144 extends in the direction opposite to that of the receiver 114 so as to have an emitting region where the electromagnetic waves are emitted at a position distant from the receiver 114. Preferably, the second ground portion 142 is configured to have the emitting portion 144 generating the amount of electromagnetic waves to be greater than that of electromagnetic waves generated at the periphery of the receiver 114. In addition, the first ground portion 141 may be configured to minimize a current flowing from the diverged point 143 to the receiver 114 so that the amount of the electromagnetic waves generated at the periphery of the receiver 114 can be reduced.

Operation of the present invention will be described based on the above embodiment. Electromagnetic waves are emitted from the portable terminal 100 when the antenna 131 of the portable terminal 100 transmits/receives the signal while performing a radio communication function. The largest amount of electromagnetic waves are generated at the periphery of the antenna 131 in the portable terminal, but the electromagnetic waves may be generated at the ground unit 140 electrically connected to the antenna 131. Particularly, an end portion of the ground unit 140 facing the antenna 131 of the terminal body may emit large amounts of electromagnetic waves. If the second ground portion 142 were not provided, large amounts of electromagnetic waves could also be generated at the periphery of the receiver 114, which would cause interference with a user's hearing aid. However, in this exemplary embodiment, the second ground portion 142 extends from the diverged point 143 of the first ground portion 141 in the direction different from that of the receiver 114 and the current flowing from the diverged point 143 to the receiver 114 is minimized. Accordingly, the amount of electromagnetic waves generated at the periphery of the receiver 114 can be reduced.

Figure 5:
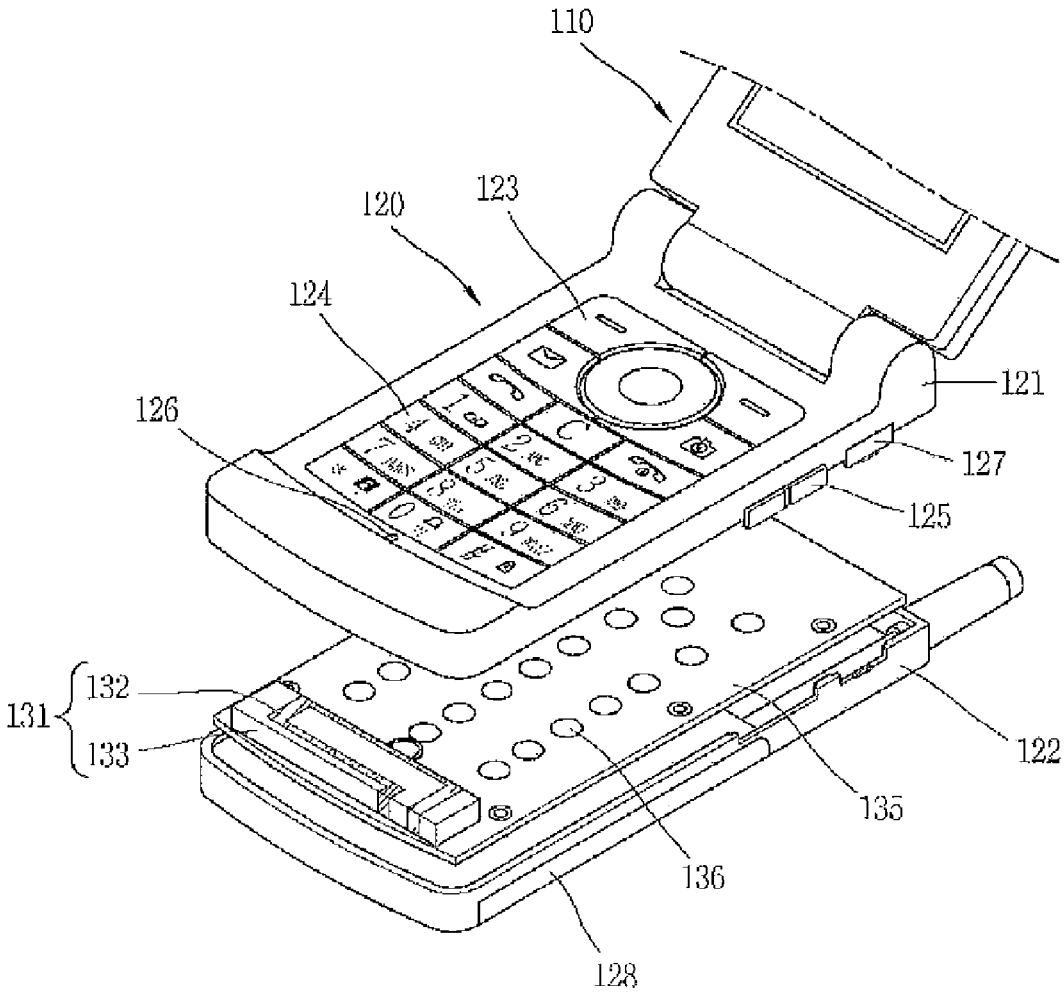
FIG. 5 is a partial exploded perspective view of a second body of the portable terminal of FIG. 2.

Hereafter, an embodiment of the ground unit 140 will be described with reference to FIG. 5, which is a partial exploded perspective view of the second body 120 of the portable terminal 100. A circuitry supporting substrate 135, such as a printed circuit board, is mounted in the inner space between the front case 121 and the rear case 122 of the second body 120. The circuitry supporting substrate 135 is provided with electronic components for operating various functions of the portable terminal 100, for example, switches 136 that are pressable by the first and second manipulating portions 123, 124 to input information. The antenna 131 may be mounted at one end of the circuitry supporting substrate 135.

The antenna 131 includes an emitting body 132 formed of a conductive material and a carrier 133 supporting the emitting body 132 thereon. The carrier may include a feeding portion supplying the signals received by the emitting body 132 to the circuitry supporting substrate 135 by connecting the emitting body 132 to the circuitry supporting substrate 135. The antenna 131 is mounted at an end portion of the second body 120 facing the hinge of the second body 120 so as to minimize interference between the antenna 131 and other electronic components on the circuitry supporting substrate 135 and to reduce an overall thickness of the second body 120.

The first ground portion 141 (Shown in FIG. 4) may be formed to cover a partial region of the second body 120 or the entire second body 120, and is electrically connected to the antenna 131. The first ground portion 141 may be a metallic pattern formed at the inside or the surface of the circuitry supporting substrate 135, a metallic structure attached to the front case 121 or the rear case 122, an EMI (Electromagnetic Interference) barrier material coated on the front case 121 or the rear case 122, or the like.

Figure 6:
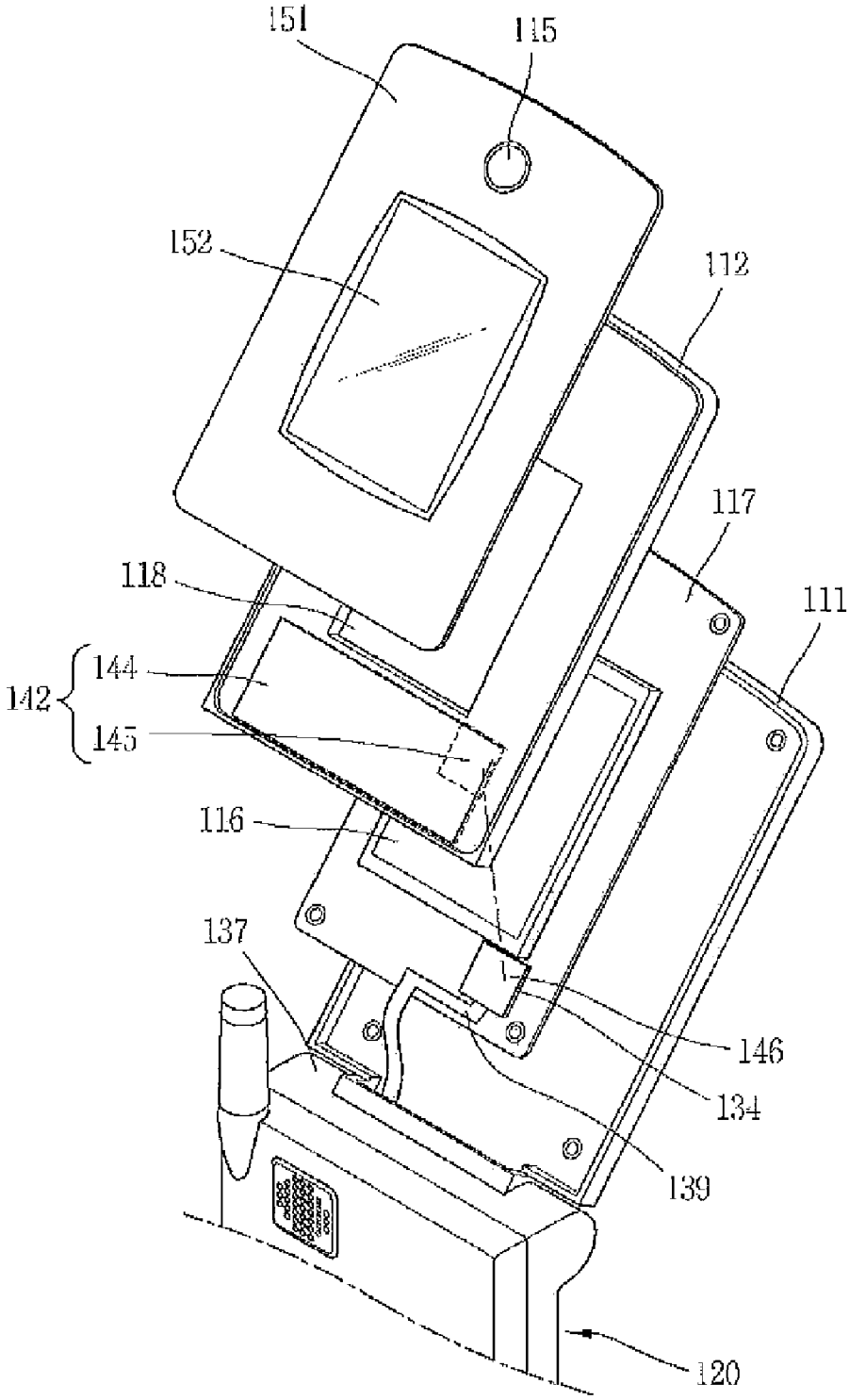
FIG. 6 is a partial exploded rear perspective view of a first body of the portable terminal of FIG. 3.

FIG. 6 is an exploded rear perspective view of the first body 110 of the portable terminal 100. The circuitry supporting substrate 117 is located between the front case 111 and the rear case 112 of the first body 110. A liquid crystal display (LCD) module, an organic light emitting diodes (OLED) module, or the like can be located on the front surface of the circuitry supporting substrate 117 to provide a second display portion 116. An installation hole 118 for installing the second display portion 116 is formed at the rear case 112, and the second ground portion 142 is located at the lower side of the installation hole 118. The receiver 114 (Shown in FIG. 4) is located at one end of the rear surface of the circuitry supporting substrate 117.

As described above, the second ground portion 142 includes the emitting portion 144 and the ground connecting portion 145. In this exemplary embodiment, the emitting portion 144 may be formed of a conductive material at a certain region on the rear case 112 and extends in a direction different from that of the receiver 114. The emitting portion 144 may be configured to have a relatively large area in the rear case 112 by being implemented as a metallic thin film, an EMI barrier material, or the like that is formed of the conductive material. The ground connecting portion 145 may extend in a direction toward the rear surface of the rear case 112 from a region of the emitting portion 144 so as to be connected to the circuitry supporting substrate 117.

A connector 134 is mounted at the lower portion of the second display portion 116 on the circuitry supporting substrate 117, and a flexible circuitry supporting substrate 139, such as a flexible printed circuit board (FPCB), electrically connects the first body 110 and the second body 120 to the connector 134. In this exemplary embodiment, the flexible circuitry supporting substrate 139 is connected to the circuitry supporting substrate 135 (Shown in FIG. 5) located in the second body 120 through a hinge connecting unit 137. The connector 134 may be configured to minimize the current flowing toward the receiver 114.

A ground contact portion 146 may be provided at the connector 134, and the ground connecting portion 145 may contact the ground contact portion 164 such that the emitting portion 144 of the second ground portion 142 is electrically connected to the first ground portion 141 (Shown in FIG. 4). In this exemplary embodiment, the ground contact portion 146 performs the same function as that of the diverged point 143 described above.

The first ground portion 141 may be a conductive material formed as a metallic pattern at the inside of or on the surface of the circuitry supporting substrate 117, a metallic structure attached to the front case 111, a EMI (Electromagnetic Interference) barrier material coated on the front case 111, or the like. Preferably, the structure formed by the conductive material disposed at the region for the receiver 114 and the region of the periphery of the receiver 114 is minimized.

As described above, because the second ground portion 142 is formed opposite to a side of the portable terminal 100 that contacts a user's face, the electromagnetic waves may be directed away from the user's face.

A cover 151 is additionally mounted on a front surface of the rear case 112 to cover the rear case 112 and the second ground portion 142. A transparent window 152 is formed at the cover 151 so that information displayed on the second display portion 116 can be seen through the cover 151.

Figure 7:
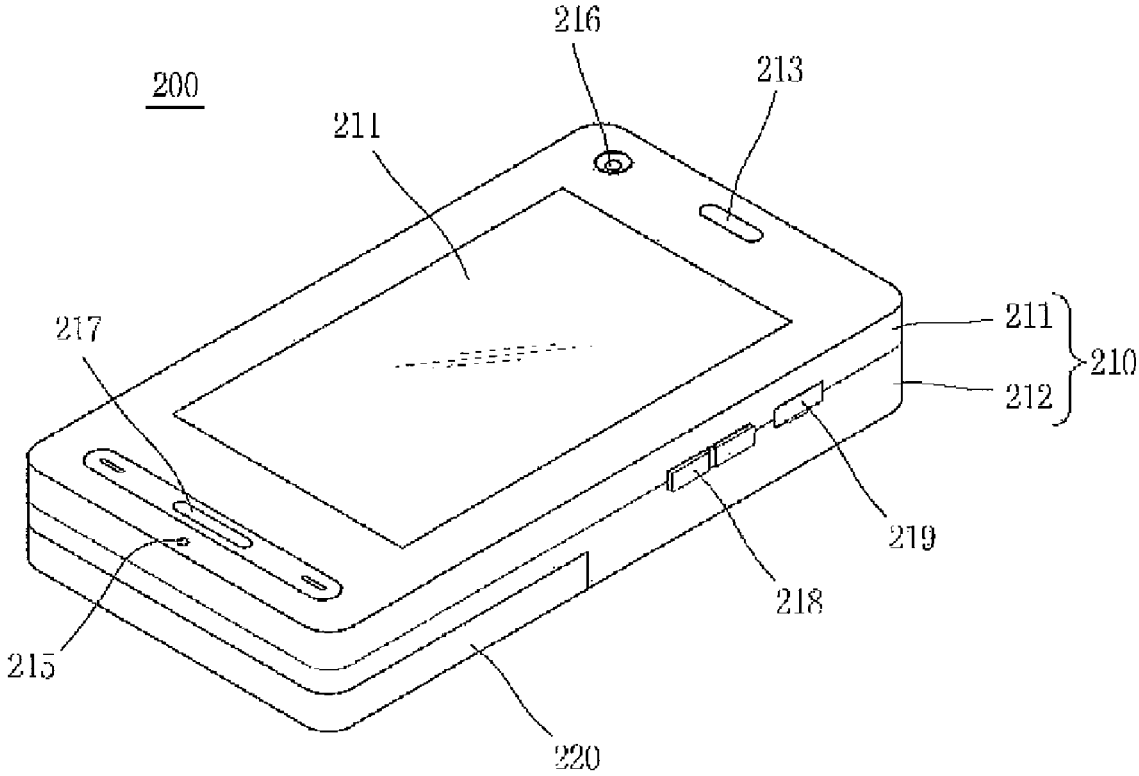
FIG. 7 is a front perspective view of a portable terminal in accordance with a second exemplary embodiment of the present invention.
Figure 8:
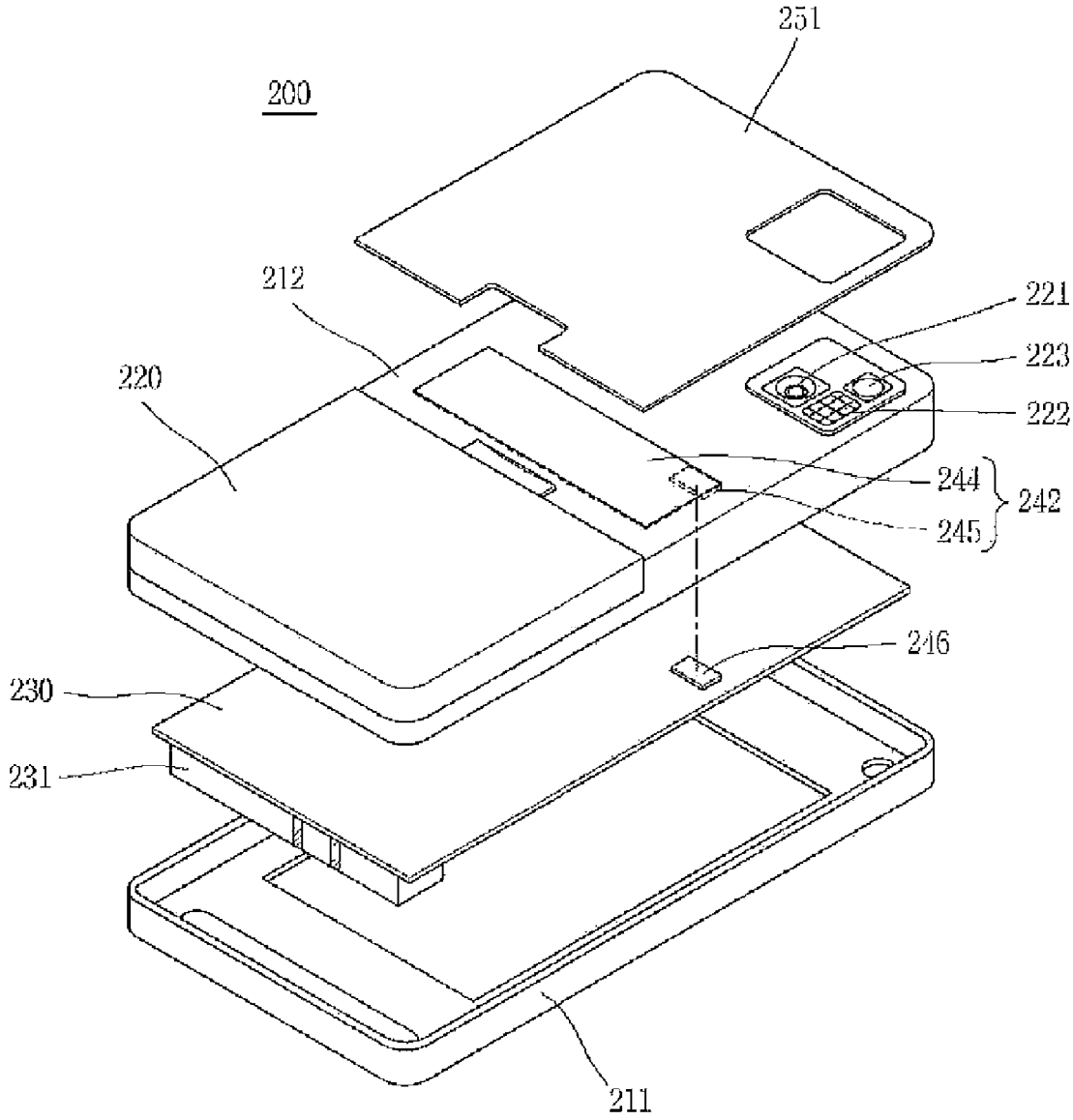
FIG. 8 is an exploded rear perspective view of the portable terminal of FIG. 7.

FIG. 7 is a front perspective view showing a portable terminal 200 in accordance with a second exemplary embodiment of the present invention, and FIG. 8 is an exploded rear perspective view of the portable terminal 200. The portable terminal 200 of this exemplary embodiment includes a terminal body 210 forming an exterior of the terminal 200. The terminal body 210 includes a front case 211 and a rear case 212. A receiver 213 is located at one end of the front case 211. The front case 211 also includes a display portion 214, a first image input unit 216, and a first manipulating portion 217 mounted at the front case 211. A second manipulating portion 218, a sound input unit 215, an interface 219, and a power supply unit 220 are mounted at least one of the front case 211 and the rear case 212. A circuitry supporting substrate 230 is located between the front case 211 and the rear case 212. An antenna 231 may be mounted at one end of the circuitry supporting substrate 230.

The rear case 212 includes a second image input unit 221. The second image input unit 221 is oriented substantially opposite to that of the first image input Unit 216, and may be a camera having different number of pixels from the number of pixels of the first image input unit 216. For example, the first image input unit 216 may have a low number of pixels so that the user can photograph himself/herself to transmit to another party, and the second image input unit 221 may have a high number of pixels for capturing images or video that is not intended to be transmitted during a call. A flash 211 and a mirror 223 are disposed adjacent to the second image input unit 221. When photographing the subject by using the second image input unit 221, the flash 222 directs light onto the subject. When the user photographs himself/herself by using the second image input unit 221, the mirror portion 223 can be used for the user to look at himself/herself therein.

A ground unit of this exemplary embodiment is similar to that of the ground unit 140 of the first embodiment, and, in particular, a second ground portion 242 is formed at the rear case 212 of the terminal body 210. The second ground portion 242 includes an emitting portion 244 for emitting electromagnetic waves out of the terminal body 210, and a ground connecting portion 245 electrically connecting the emitting portion 244 to a first ground portion (not shown). The emitting portion 244 may be disposed at the rear case 212 or at an upper portion of the power supply unit 220. The emitting portion 244 extends in a direction opposite to that of the receiver 213. The ground connecting portion 245 extends from one region of the emitting portion 244 so as to contact the circuitry supporting substrate 230. A ground contact portion 246 is formed at the surface of the circuitry supporting substrate facing the rear case 212, and the ground connecting portion 245 contacts the ground connecting portion 245. A cover 251 is provided on the rear case 212 to cover the emitting portion 244. The operation of ground unit in accordance with this embodiment is similar to that of the previous embodiment, and thus will be omitted.

In the above description, the present invention is described based on a folder-type and a bar-type portable terminal, but it is not limited thereto. The portable terminal according to the present invention may be applied to various types of portable terminals such as a slide-type p, a swivel-type, a swing-type portable terminal, and the like.

As described above, the portable terminal in accordance with the present invention is provided with the second ground portion connected to the first ground portion at a position spaced from the receiver by a certain distance and thus extends in a direction different from that of the receiver. As a result, the amount of the electromagnetic waves generated from the periphery of the receiver can be reduced, thereby minimizing interference between the hearing aid and the electromagnetic waves generated from the portable terminal.

Further, the portable terminal in accordance with the present invention may be provided with the second ground portion formed at the rear case of the first body and extended in the direction opposite to that of the receiver. As a result, the emitting region of the electromagnetic waves can be formed at a region which is as far as possible from the hearing aid.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

What is claimed is:

1. A portable terminal comprising:

a terminal body having a front case and a rear case coupled to the front case;

an antenna disposed in the terminal body;

a receiver located in the terminal body, the receiver being oriented in a first direction; and a ground unit located in the terminal body, the ground unit including:

a first ground portion connected to the antenna; and a second ground portion connected to the first ground portion at a position on the first ground portion at a distance from the receiver, formed at the rear case, and configured to emit electromagnetic waves in a second direction away from the first direction, wherein the second ground portion includes:

an emitting portion for emitting electromagnetic waves, the emitting portion being spaced from the first ground portion and adjacent the rear case; and a connecting portion extending between the first ground portion and the emitting portion.

2. The portable terminal of claim 1, wherein the receiver is located at a first end of the terminal body and the antenna is located at a second end of the terminal body opposite the first end of the terminal body.

3. The portable terminal of claim 1, wherein the terminal body includes:

a first body having a first end and a second end, the receiver being located at the first end of the first body; and a second body having a first end pivotally connected to the second end of the first body.

4. The portable terminal of claim 3, wherein the first end of the second body is pivotally connected to the second end of the first body via a hinge, and the antenna is located at the second end of the second body.

5. The portable terminal of claim 3, further comprising a first circuitry supporting substrate located in the first body, wherein the connecting portion of the second ground portion is electrically connected to the first circuitry supporting substrate.

6. The portable terminal of claim 5, further comprising:

a second circuitry supporting substrate, the second circuitry supporting substrate being located in the second body;

a connector located on the second circuitry supporting substrate, the connector having a portion that contacts the connection portion of the second ground portion; and a flexible circuitry supporting substrate electrically connecting the first circuitry supporting substrate to the second circuitry supporting substrate via the connector located on the second circuitry supporting substrate.

7. The portable terminal of claim 3, wherein the emitting portion is one of a film formed of a conductive material attached to the rear case and an EMI barrier material coated on the rear case.

8. The portable terminal of claim 3, wherein the emitting portion extends in a direction away from the receiver.

9. The portable terminal of claim 1, the terminal body further comprising a circuitry supporting substrate located in the terminal body, wherein the connecting portion of the second ground portion is electrically connected to the circuitry supporting substrate.

10. The portable terminal of claim 9, further comprising a connector located on the circuitry supporting substrate, the connector having a portion that contacts the connection portion of the second ground portion.

11. A portable terminal comprising:

a terminal body having a front case and a rear case coupled to the front case;

a receiver located in the terminal body;

an antenna located in the terminal body;

a first circuitry supporting substrate disposed in the terminal body; and a ground unit located in the terminal body, the ground unit including:

a first ground portion formed in the first circuitry supporting substrate and connected to the antenna; and a second ground portion connected to the first ground portion at a position spaced from the receiver, formed at the rear case, and extending in a direction away from the receiver, wherein the second ground portion includes:

an emitting portion located adjacent the rear case to emit electromagnetic waves through the rear case; and a connecting portion extending between the emitting portion and the first circuitry supporting substrate to electrically connect the emitting portion and the first circuitry supporting substrate.

12. The portable terminal of claim 11, wherein the receiver is located at a first end of the terminal body and the antenna is formed at a second end of the terminal body opposite the first end.

13. The portable terminal of claim 11, wherein the terminal body includes:

a first body having one end provided with the receiver; and a second body pivotally connected to the first body by a hinge.

14. The portable terminal of claim 13, wherein the antenna is provided at an end portion of the second body facing the hinge of the second body.

15. The portable terminal of claim 13, wherein the circuitry supporting substrate is located in the first body.

16. The portable terminal of claim 15, further comprising a connector located on the first circuitry supporting substrate, the connector having a portion that contacts the connection portion of the second ground portion.

17. The portable terminal of claim 16, further comprising:

a second circuitry supporting substrate, the second circuitry supporting substrate being located in the second body; and a flexible circuitry supporting substrate electrically connecting the first circuitry supporting substrate to the second circuitry supporting substrate via the connector located on the second circuitry supporting substrate.

18. The portable terminal of claim 15, wherein the emitting portion is implemented as a film formed of a conductive material and attached to the rear case or an EMI barrier material coated on the rear case.

19. The portable terminal of claim 15, wherein the emitting portion is one of a film formed of a conductive material attached to the rear case and an EMI barrier material coated on the rear case.

20. The portable terminal of claim 15, wherein the emitting portion extends in a direction away from the receiver.

21. A portable terminal comprising:

a terminal body having a front case and a rear case coupled to the front case;

a receiver mounted in the terminal body and exposed to the front case;

an antenna installed in the terminal body; and a ground unit located in the terminal body, the ground unit comprising:

a first ground portion connected to the antenna; and a second ground portion connected to the first ground portion at a position spaced from the receiver, formed at the rear case, and extending in a direction away from the receiver.

* * * * *